US009811986B2

(12) United States Patent
Loidreau et al.

(10) Patent No.: US 9,811,986 B2
(45) Date of Patent: Nov. 7, 2017

(54) METHOD AND DEVICE FOR DETERMINING AN UNAUTHORIZED INTRUSION AT A DOOR

(71) Applicant: Robert Bosch GmbH, Stuttgart (DE)

(72) Inventors: Maxime Loidreau, Vinay (FR); Julian Bartholomeyczik, Reutlingen (DE); Frank Schindler, Reutlingen (DE); Qiulu Dai, Reutlingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 15/112,221

(22) PCT Filed: Nov. 27, 2014

(86) PCT No.: PCT/EP2014/075739
§ 371 (c)(1),
(2) Date: Jul. 18, 2016

(87) PCT Pub. No.: WO2015/110204
PCT Pub. Date: Jul. 30, 2015

(65) Prior Publication Data

US 2016/0343217 A1 Nov. 24, 2016

(30) Foreign Application Priority Data

Jan. 22, 2014 (DE) ..... 10 2014 201 130

(51) Int. Cl.
*G08B 13/08* (2006.01)

(52) U.S. Cl.
CPC ..... *G08B 13/08* (2013.01)

(58) Field of Classification Search
CPC ..... G08B 13/08; G08B 13/10; G08B 13/122; G08B 17/00; E06B 9/0623; G07C 9/00103; E05Y 2800/252; B62H 5/142
(Continued)

(56) References Cited

U.S. PATENT DOCUMENTS 4,427,975 A * 1/1984 Kinzie ..... G08B 13/08 340/528
4,990,898 A * 2/1991 Greene ..... G08B 13/08 200/61.7
(Continued)

FOREIGN PATENT DOCUMENTS

CN 201705043 U 1/2011
CN 202047658 U 11/2011
(Continued)

OTHER PUBLICATIONS

International Search Report dated Feb. 27, 2015, of the corresponding International Application PCT/EP2014/075739 filed May 3, 2015, 2 pages.

*Primary Examiner* — George Bugg
*Assistant Examiner* — Munear Akki
(74) *Attorney, Agent, or Firm* — Norton Rose Fulbright US LLP; Gerard Messina

(57) ABSTRACT

A method for determining the unauthorized intrusion through a door, including: a) determining a movement path of the door as a function of time in all three spatial axes using a movement sensor in an active mode; b) determining parameters in all three spatial axes based on the movement path of the door, an unauthorized intrusion at the door exists when the actual value of the particular parameter is within an assigned parameter range for the unauthorized intrusion; c) determining an opening angle of the door using an angle measuring sensor when an unauthorized intrusion has been determined; and d) comparing the opening angle of the door with a threshold value for a closed door; e) determining that the door has been opened when the opening angle exceeds the threshold value, and outputting an alarm signal if the door has been opened. A device is also described.

18 Claims, 4 Drawing Sheets

(58) Field of Classification Search
USPC ..... 340/545.1, 545.5, 545.8, 541, 693, 5.7, 340/665, 686.1; 70/277; 49/31
See application file for complete search history.

(56) References Cited

U.S. PATENT DOCUMENTS

| | | | | | |
|---|---|---|---|---|---|
| 5,455,562 | A * | 10/1995 | Chin | G08B 13/08 | 340/542 |
| 6,259,352 | B1 * | 7/2001 | Yulkowski | E05B 47/00 | 340/5.7 |
| 6,310,548 | B1 * | 10/2001 | Stephens, Jr. | G08B 13/08 | 340/540 |
| 6,472,993 | B1 * | 10/2002 | Addy | G08B 13/2491 | 340/539.1 |
| RE42,991 | E * | 12/2011 | Cook | G08B 23/00 | 340/539.1 |
| 8,253,563 | B2 | 8/2012 | Burnard | | |
| 2003/0014919 | A1 * | 1/2003 | Diaz-Lopez | E05B 47/00 | 49/31 |
| 2004/0261478 | A1 * | 12/2004 | Conforti | G07C 9/00103 | 70/277 |
| 2005/0030179 | A1 | 2/2005 | Script | | |
| 2005/0253710 | A1 * | 11/2005 | Eskildsen | G08B 13/08 | 340/545.5 |
| 2008/0030179 | A1 | 2/2008 | Yen | | |
| 2008/0157964 | A1 * | 7/2008 | Eskildsen | G08B 13/08 | 340/545.1 |
| 2011/0043362 | A1 * | 2/2011 | Reibel | G07C 9/00103 | 340/541 |

FOREIGN PATENT DOCUMENTS

| | | |
|---|---|---|
| CN | 102737463 A | 10/2012 |
| DE | 102008022276 | 11/2009 |
| DE | 202009010418 | 12/2010 |
| EP | 0403588 | 12/1990 |
| EP | 1652159 | 5/2006 |

* cited by examiner

METHOD AND DEVICE FOR DETERMINING AN UNAUTHORIZED INTRUSION AT A DOOR

FIELD

The present invention relates to a method and a device for determining an unauthorized intrusion at a door, in particular a door which protects a room against an unauthorized intrusion, such as, e.g., the front door, the garage door, the apartment door, etc.

BACKGROUND INFORMATION

European Patent No. EP 0 403 588 A1 describes a system in which an infrared light beam is directed onto a door and the infrared light beam reflected by the door is utilized for detecting an unauthorized intrusion. In this case, the system consumes a considerable amount of energy and is not optimal for an independent operation in which it is supplied with electrical energy only by a normal battery.

U.S. Pat. No. 8,253,563 B2 describes multiple sensors and a microcontroller, which, together, form a system for detecting a forcible intrusion at a door on the basis of statistically ascertained sensor signals. The disadvantage in this case is that physical variables which describe the position and the movement of the door are not taken into account in the detection of the forcible intrusion at the door.

In addition, in European Patent No. EP 1 652 159 A2, a gyroscope, a MEMS acceleration sensor, a piezoelectric acceleration sensor and a magnetic field sensor are utilized. In this case, the principle for detecting a door movement is based on audio signals. An extensive and expensive signal processing unit is necessary in order to achieve this, since audio signals must be generated and evaluated. This complex unit also requires a great deal of energy to operate.

SUMMARY

The present invention provides a method for determining an unauthorized intrusion at a door, and a device for determining an unauthorized intrusion at a door.

Preferred refinements are described herein.

The present invention provides a method and a device, with which an unauthorized intrusion at the door or at any other closure of an opening in a wall, for example, a window or a portal, which is referred to in the following as a door, may be reliably determined, by way of, on the one hand, determining a movement of the door with the aid of a movement sensor and evaluating the movement on the basis of parameters, with the aid of which an unauthorized intrusion at the door may be distinguished from an authorized intrusion at the door. On the other hand, whether or not an established unauthorized intrusion was successful is verified by determining the opening angle of the door using an angle measuring sensor and, on the basis thereof, determining whether the door has been opened or is still within a tolerance range for a closed door.

In accordance with the present invention, the movement of the door is detected as a function of time on the basis of a movement sensor, since an unauthorized intrusion at the door, such as, e.g., the door being opened with the aid of a picklock, has a characteristic sequence of movements of the door, which may be able to be differentiated from other occurrences at the door and the particular movement of the door associated therewith. For this purpose, parameters are determined from the sequence of movements, on the basis of which the sequence of movements for an unauthorized intrusion may be able to be differentiated from other occurrences at the door.

In one specific embodiment of the present invention, the angle measuring sensor is only activated by the receiver and evaluation unit in order to measure the opening angle of the door when an unauthorized intrusion has been determined by the receiver and evaluation unit. The energy consumption may be reduced as a result, since the angle measuring sensor does not need to be constantly activated. In addition, an evaluation of the signals from the angle measuring sensor is carried out by the receiver and evaluation unit only in order to determine whether the established unauthorized intrusion has resulted in the door being opened or not. If an unauthorized intrusion is not established, however, an evaluation of the signals from the angle measuring sensor does not take place. Energy may also be saved in this way.

In a further specific embodiment of the present invention, the movement sensor detects, in step a) in a stand-by mode, the application of a force onto the door and transmits a signal, for example a binary signal, to the receiver and evaluation unit if the force on the door exceeds a threshold value for a minimal force. As soon as the receiver and evaluation unit receives the signal from the movement sensor, the receiver and evaluation unit, in the active mode, activates the movement sensor in such a way that the movement sensor not only detects, as previously, a force which is greater than a predetermined threshold value but now also detects the movement path of the door in all three spatial axes as a function of time. The energy consumption may also be reduced by way of the movement sensor being initially operated in a stand-by mode before it carries out more comprehensive measurements in an active mode.

In one specific embodiment of the present invention, the receiver and evaluation unit activates a timer in step b) when an unauthorized intrusion at the door has been determined, the opening angle is determined in step c) and the opening angle is compared with the threshold value in step d) being repeated until either it is determined within the predefined period of time in step e) that the door has been opened or that the period of time predefined by the timer has expired and an opening of the door has not been determined in step e), the receiver and evaluation unit returning to the stand-by mode of step a) when the predefined period of time has expired and an opening of the door has not been determined in step e). By way of a timer specifying a predetermined period of time within which the steps of determining the opening angle and comparing the threshold value of the opening angle of the door are repeated, it may be prevented that the opening angle is continuously checked, even when an opening of the door has not been established. Instead, the stand-by mode may be returned to and it may be determined whether a successful unauthorized intrusion at the door exists only when a suitably great force is being applied onto the door.

In another specific embodiment of the present invention, parameter ranges for multiple occurrences of an unauthorized intrusion are retrievably stored in the memory unit, the receiver and evaluation unit determining, in step b), that an occurrence of unauthorized intrusion at the door exists when the actual value of the particular parameter is within the assigned parameter range for the occurrence of unauthorized intrusion. Examples of occurrences of unauthorized intrusion at the door are occurrences such as the unauthorized intrusion at the door with the aid of a picklock, the unauthorized intrusion at the door with the aid of a pry bar and/or the unauthorized intrusion at the door by ramming the door with the body. Parameter ranges for each spatial axis are assigned to each of these occurrences and are retrievably stored in the memory unit in order to be compared with corresponding actual values of the parameters.

In addition, in a further specific embodiment of the present invention, parameter ranges for multiple occurrences of authorized intrusion are retrievably stored in the memory unit, the occurrences of authorized intrusion at the door being, for example, occurrences such as authorized intrusion at the door by knocking on the door, the authorized intrusion at the door by a toy car striking the door, authorized intrusion at the door by a shopping bag striking the door and/or authorized intrusion at the door by opening the door using the assigned key. In step b), the receiver and evaluation unit determines that an occurrence of authorized intrusion at the door exists when the actual value of the particular parameter is within the assigned parameter range for the occurrence of the authorized intrusion. The receiver and evaluation unit then returns to the stand-by mode, in step a). This has the advantage that, in the case of authorized intrusion at the door, no further detection and evaluation of the opening angle of the door is necessary and, therefore, a check takes place only when a sufficiently great force is applied to the door again and is detected by the movement sensor.

Parameters which may be utilized for checking an unauthorized and an authorized intrusion at the door in at least one of the spatial axes are, for example, an amplitude level, a period, a duration of a pause between two consecutive periods, a number of the amplitudes which exceed a predetermined amplitude level and/or a duration of the pause between two amplitudes which exceed a predetermined amplitude level. For example, the parameters for determining unauthorized and authorized intrusion may be the same or different for each of the spatial axes, depending on which parameters for a spatial axis are suitable for distinguishing between an unauthorized intrusion and an authorized intrusion at the door.

In one specific embodiment of the present invention, the alarm signal is transmitted to an alarm unit and/or to at least one external electronic unit, the external electronic unit being, for example, a cellular phone, a smartphone, a server, a WLAN router, a PC, or a tablet PC belonging to the owner of the room closed by the door, or belonging to the police, or a security service. In this case, the alarm unit may be part of the device for determining an unauthorized intrusion at the door or may be coupleable thereto. For example, the alarm unit may be provided with an electrical outlet for supplying energy in the room closed by the door and may output a visual and/or acoustic warning signal as soon as the alarm unit receives the alarm signal.

In a further specific embodiment of the present invention, the movement sensor is, e.g., an acceleration sensor, and the angle measuring sensor is, e.g., a gyroscope. Such sensors are provided in large numbers for consumer durable goods and, therefore, are normally reasonably priced sensors.

Further features and advantages of the present invention are explained below with reference to the figures.

DETAILED DESCRIPTION OF EXAMPLE EMBODIMENTS

Figure 1:
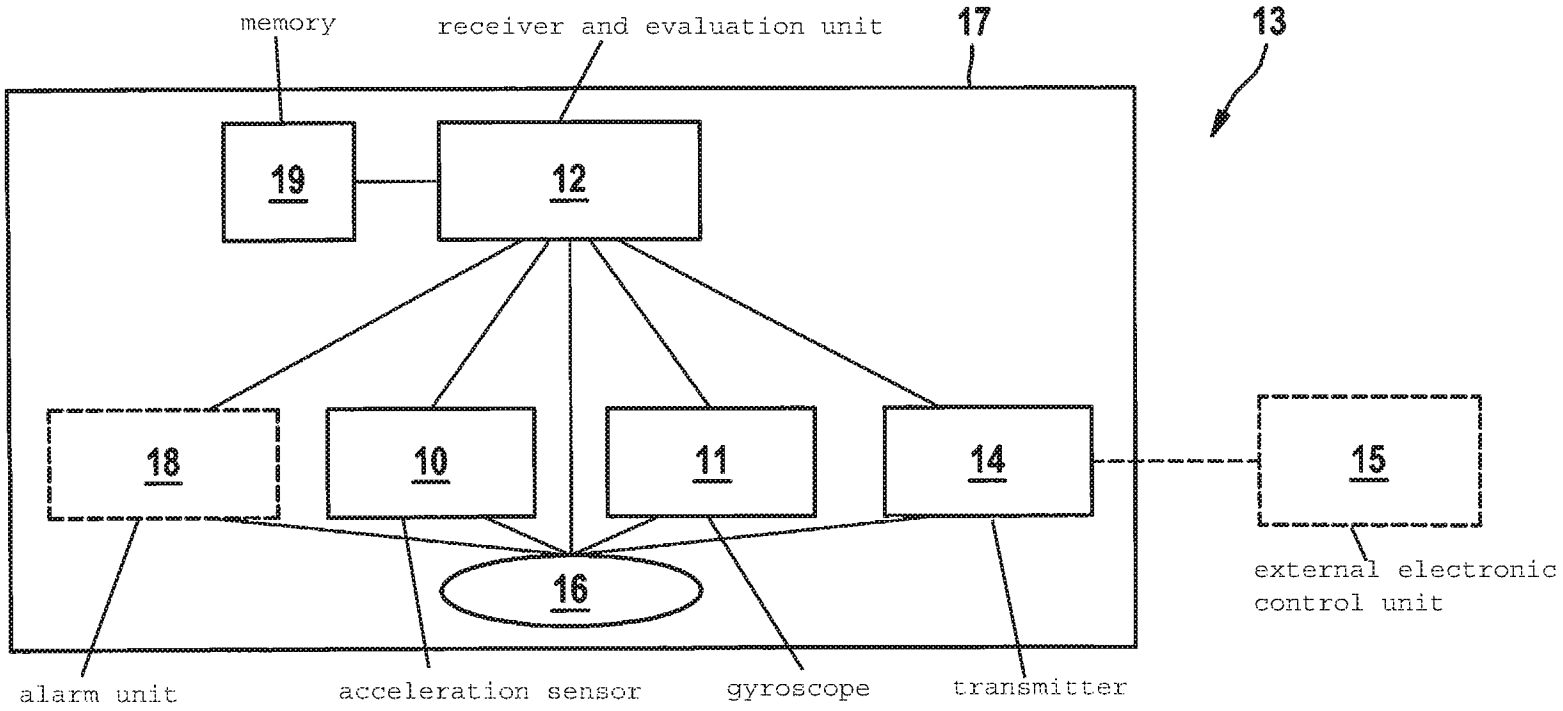
FIG. 1 shows a device for determining an unauthorized intrusion at a door, according to one specific embodiment of the present invention.

FIG. 1 shows a device for determining an unauthorized intrusion at a door, according to one specific embodiment of the present invention.

The present invention is based on a micromechanical (MEMS) acceleration sensor 10 and a micromechanical (MEMS) gyroscope 11, both of which may gather data in all three spatial axes, i.e., the x-axis, the y-axis, and the z-axis. Micromechanical (MEMS) acceleration sensors 10 and micromechanical (MEMS) gyroscopes 11 of this type are developed and produced in large numbers for durable consumer goods and, therefore, are generally reasonably priced sensors. Instead of an acceleration sensor 10 as the movement sensor, any other sensor may be used which is suitable for detecting a movement path of the door as a function of time. Moreover, in addition to gyroscope 11, any other angle measuring sensor may be used which is suitable for determining the opening angle of the door, by which the door has been deflected out of the closed state.

Sensors 10, 11 described herein and the method described herein are particularly powerful. The present invention may determine an unauthorized intrusion not only through the door. Instead, if necessary, it may also determine an unauthorized intrusion in part through windows, on the basis of occurring movements, in particular accelerations and angle changes over time at the window, i.e., physical variables which directly reflect mechanical door movements. In this way, for example, a movement of the door in at least one spatial axis may also be triggered when a person does not tamper directly with the door, but rather with a window of the room closed by the door, with the aid of a pry bar, for example. In this case, corresponding vibrations of the window may result in vibrations or movements of the closed door, which, in turn, may be detected by acceleration sensor 10 and gyroscope 11. In this case, micromechanical gyroscope 11 integrates changes in the angle of the door over time.

As described in the following, micromechanical (MEMS) acceleration sensor 10 and micromechanical (MEMS) gyroscope 11, as preferred examples of a movement sensor and an angle measuring sensor, are connected to a receiver and evaluation unit 12, e.g., a microcontroller, for receiving and evaluating the signals from sensors 10, 11. Logical operations may be carried out with the aid of receiver and evaluation unit 12.

For example, receiver and evaluation unit 12 may carry out a series of evaluations and a check based on the signals received from the sensors in order to detect or determine a movement of the door in a particular spatial axis. The combination of the movement of the door in the three spatial axes as a function of time provides for a reliable determination of an unauthorized intrusion through the door. Impacts on the door carried out in order to gain an unauthorized intrusion, such as, e.g., opening the door and the door lock by forcing them open with the aid of a pry bar or with the aid of a picklock, etc., are distinguished from impacts on the door which occur during a normal access situation, such as, e.g., opening the door with the aid of the assigned key or knocking on the door or striking the door with a shopping bag or a child's toy, etc.

The device for determining an unauthorized intrusion at door 13 includes, in FIG. 1, micromechanical (MEMS) acceleration sensor 10 and micromechanical (MEMS) gyroscope 11 as examples of a movement sensor and an angle measuring sensor, and receiver and evaluation unit 12 for receiving and determining a door movement based on the signals from acceleration sensor 10 and from gyroscope 11, as shown in FIG. 1. In this case, the acceleration sensor or three-axis acceleration sensor detects the acceleration in $m/s^2$ in all three spatial axes as a function of time. The gyroscope or the rotation rate sensor, as an example of an angle measuring sensor, detects the angular degree once per second. The opening angle of the door may be calculated by the receiver and evaluation unit, e.g., by integration of the rotation rate signals received from the gyroscope.

In addition, the device for determining unauthorized intrusion at door 13 includes a transmitter 14, which is connected to receiver and evaluation unit 12 and is coupleable to an external electronic unit 15 for transmitting an alarm signal from receiver and evaluation unit 12 indicating that, for example, an unauthorized intrusion at the door exists due to an occurrence such as, e.g., the door being opened with the aid of a picklock.

External electronic unit 15 is indicated in FIG. 1 by a dashed line and is, for example, a cellular phone, a smartphone, a fax machine, a laptop, a tablet PC, a server, e.g., belonging to the owner of the room to be protected by the door against an unauthorized intrusion, or belonging to the police, or a security company, etc. In this case, transmitter 14 may be connected to external electronic unit 15 in a wired or wireless manner, e.g., via radio signals, etc., for the wired or wireless transmission of the alarm signal from receiver and evaluation unit 12 to external electronic unit 15. In this case, the alarm signal may include not only the information that an unauthorized intrusion exists, but other information as well, such as, e.g., the type of unauthorized intrusion, e.g., an unauthorized opening of the door with the aid of a picklock or an unauthorized opening of the door by ramming the door, etc., the point in time of the unauthorized intrusion, the door at which the unauthorized intrusion is taking place, etc.

The device for determining an unauthorized intrusion at a door 13 further includes an energy supply unit 16, in particular at least one battery, for supplying acceleration sensor 10, gyroscope 11, receiver and evaluation unit 12, and transmitter 14 with energy.

Acceleration sensor 10, gyroscope 11, receiver and evaluation unit 12 and/or transmitter 14 may be situated in a housing 17, e.g., on a circuit board (PCB) not shown, which is mechanically coupled to the door. In addition, energy supply unit 16, for example, is also provided in housing 17, as shown in FIG. 1.

The device for determining an unauthorized intrusion at a door 13 also optionally includes an additional alarm unit 18, as is indicated by a dotted line in FIG. 1, or is coupled to such an alarm unit. A warning signal, in particular a visual and/or acoustic warning signal, is output with the aid of alarm unit 18 when an unauthorized intrusion at the door is determined by receiver and evaluation unit 12. Alarm unit 18 may be part of the device for determining an unauthorized intrusion at a door 13 and may be situated in housing 17. In this case, alarm unit 18 may also be supplied with energy by energy supply unit 16. In addition, alarm unit 18 may also be situated outside the device for determining an unauthorized intrusion at a door 13 inside, e.g., the room closed by the door and, there, may be connected to an energy supply unit, e.g., an electrical outlet, or may have its own energy supply unit. Alarm unit 18 in this case is coupled, in a wireless or wired manner, to the device for determining an unauthorized intrusion at a door 13 and triggers a warning signal as soon as it receives the alarm signal from receiver and evaluation unit 12.

Receiver and evaluation unit 12 also includes a memory unit 19. In this case, ranges for values of parameters are stored in memory unit 19, which are obtained on the basis of the movement sensor, e.g., acceleration sensor 10, and characterize movement patterns of the door in the three spatial axes for an unauthorized and an authorized intrusion at the door.

In this case, ranges for values of the parameters in all three spatial axes for different occurrences of an unauthorized intrusion, such as, e.g., the door lock being opened with the aid of a picklock, the door being opened with the aid of a pry bar, and different occurrences of an authorized intrusion, such as, e.g., the door being opened with the aid of the assigned key, a knocking on the door, the door being struck by a child with a toy, or the door being struck by a shopping bag, etc. may be stored in the memory unit, retrievable by the receiver and evaluation unit. Receiver and evaluation unit 12 ascertains, on the basis of the movement signals detected by acceleration sensor 10, the actual values of the parameters and compares them with the ranges of these parameters for the different occurrences of authorized and unauthorized intrusions at the door, the ranges being stored in the memory unit. If the actual values of the parameters, for example, for at least one or preferably all spatial axes, fall into the assigned stored ranges for an occurrence of an unauthorized intrusion, a check is carried out in a next step to determine whether the door is being opened in this case, or not. For this purpose, the opening angle of the door, by which the door has been deflected out of its closed position, is calculated and evaluated by receiver and evaluation unit 12 from the rotation rate signals detected by gyroscope 11. In this case, receiver and evaluation unit 12 compares the actual opening angle with a threshold value for a closed door, the threshold value also being retrievably stored in the memory unit. If the actual value exceeds the threshold value, receiver and evaluation unit 12 determines that the unauthorized opening of the door was successful and the door has been opened, e.g., with the aid of a picklock. In this case, receiver and evaluation unit 12 outputs an alarm signal.

The device for determining an unauthorized intrusion at a door 13 is preferably provided on the inside of the door, which is not accessible from the outside by an unauthorized intruder. In this case, the device for determining an unauthorized intrusion at a door 13 is attached, with its housing, on a door surface on the inside of the door, e.g., adhesively bonded, screwed down, etc.

Figure 2:
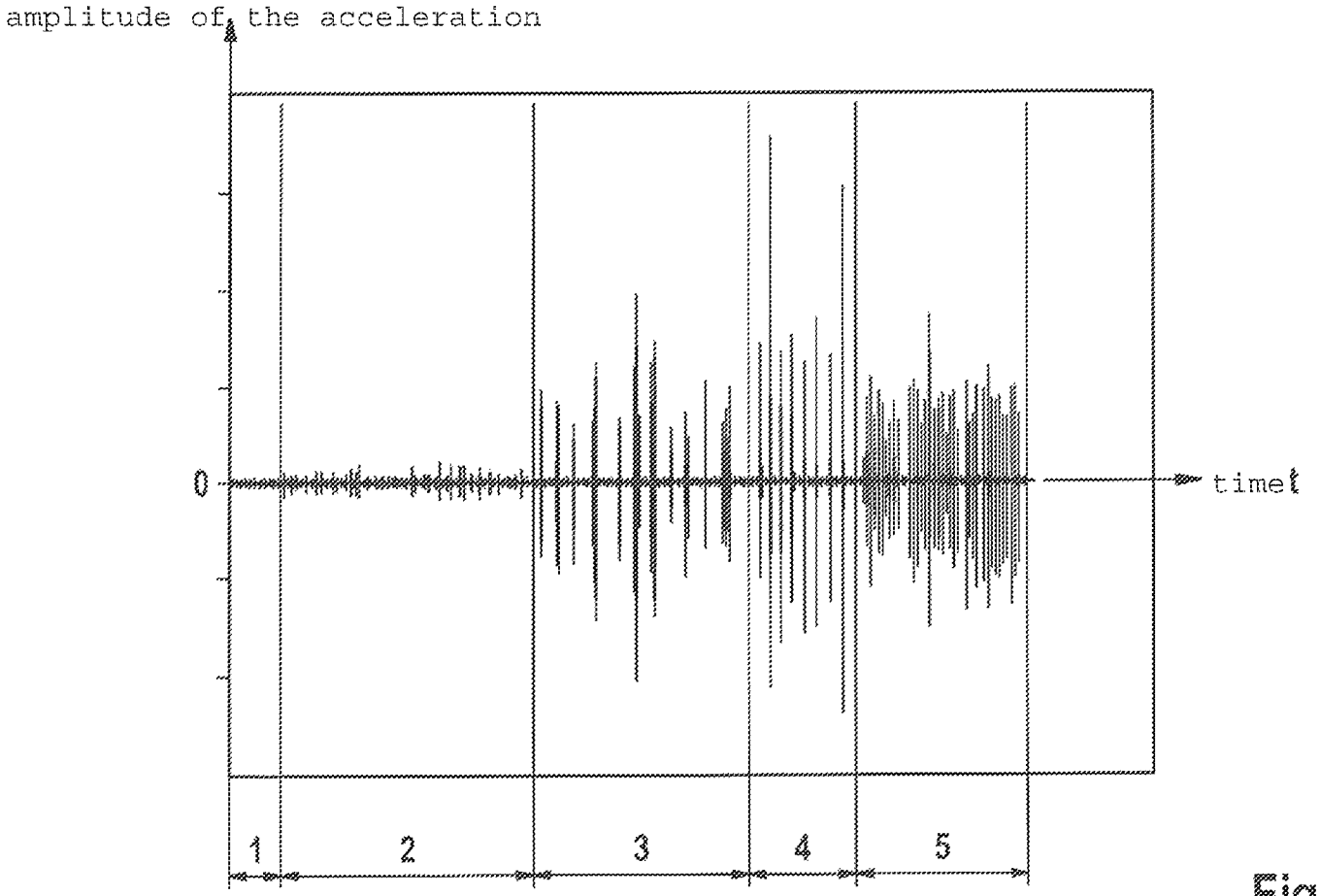
FIG. 2 shows a diagram of different movement signals from an acceleration sensor in one spatial axis.

A diagram of different examples of a movement path of the door as a function of time is shown in FIG. 2. More specifically, FIG. 2 shows examples of the acceleration of the door as a function of time, which the door undergoes when an authorized or unauthorized intrusion at the door exists. The acceleration of the door as a function of time is represented in FIG. 2 for one spatial axis, by way of example. In this case, the acceleration of the door as a function of time has a certain movement pattern or a characteristic curve in the particular spatial axis based on the particular occurrence of the authorized or unauthorized intrusion at the door.

The acceleration of the door as a function of time may be determined by the acceleration sensor for each spatial axis, transmitted to the receiver and evaluation unit, and evaluated there.

An occurrence which is evaluated as an authorized intrusion at the door is when the door is closed and does not undergo any impacts or the like which result in a movement or an acceleration of the door. This case is shown in first area 1 in FIG. 2. A door having such a movement pattern is determined to be closed and to remain closed. The minimal oscillations in first area 1 merely indicate noise from the acceleration sensor.

In addition, second area 2 shows the occurrence of the unauthorized intrusion through the door with the aid of a picklock. In this case, the diagram shows the path of the door movement when the lock of the door is picked with the aid of a picklock or a comparable device. Whether the picking of the lock was actually successful and the door has been opened is ascertained with the aid of the signals from the gyroscope.

In addition, third area 3 shows, as an authorized intrusion, the occurrence of knocking on the door. The knocking on the door may be ascertained, for example, on the basis of empirical values with the aid of multiple test subjects. A knocking process in this case includes, e.g., one to three consecutive raps. In this case, third area 3 shown in FIG. 2 represents knocking at different positions on the door.

Fourth area 4 represents the occurrence of unauthorized intrusion by ramming the door with the body. With the aid of the gyroscope, it may be determined whether the door was actually opened or not when rammed with the body.

Fifth area 5 represents the occurrence of authorized intrusion by the door being struck by a toy car.

The occurrences of the authorized intrusion shown, i.e., first, third and fifth areas 1, 3 and 5, and of the unauthorized intrusion, i.e., the second and fourth areas 2 and 4, may be able to be distinguished from one another, for example, by determining parameters such as the maximum amplitude of the oscillation, the number of amplitudes, the period, the pauses between two consecutive periods and/or the pauses between two periods which exceed a predetermined amplitude maximum, etc.

For example, the amplitude maxima of first area 1, i.e., a closed door not undergoing any impacts, are between an upper and a lower threshold value for an amplitude level of an oscillation generated by the noise from the acceleration sensor. In addition, the pause between two consecutive periods and the period duration are within an assigned, predetermined range for a closed door not undergoing any impacts or the like.

The occurrence of second area 2, of unauthorized intrusion at the door with the aid of a picklock, may be distinguished from remaining areas 1 and 3 through 5, e.g., by the fact that the amplitude level is within a range in which the amplitude level is greater than the amplitude level of the oscillation of first area 1 and is less than the amplitude level of third, fourth and fifth areas 3, 4 and 5. In addition, the pauses between two periods which exceed a predetermined amplitude level are less than in third area 3, for example.

Figure 3:
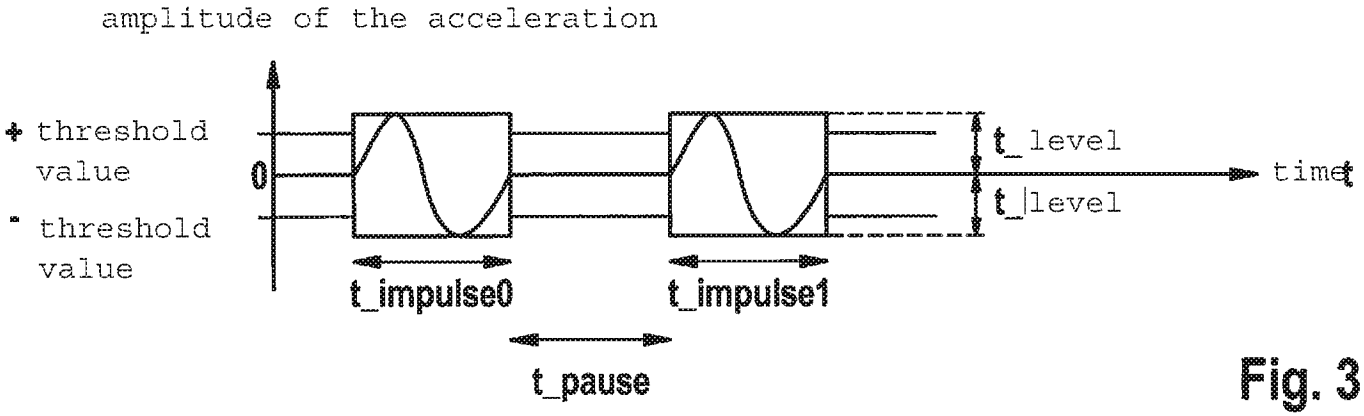
FIG. 3 shows a further diagram, which shows a movement signal from an acceleration sensor in one spatial axis.

FIG. 3 shows a further diagram, which shows a movement signal from an acceleration sensor in one spatial axis. The diagram is purely schematic and greatly simplified in this case.

As may be gathered from FIG. 3, the amplitude of the acceleration of the door is represented as a function of time t. In FIG. 3, the period is labeled in this case with t_impulse, the amplitude level is labeled with t_level, and the duration of the pause between two consecutive periods is labeled with t_pause. In addition, an upper threshold value and a lower threshold value for the amplitude level are indicated in FIG. 3. The parameters such as the period t_impulse, the duration of the pause t_pause between two consecutive periods, and the particular amplitude level t_level may be utilized for determining an occurrence of an unauthorized or an authorized intrusion at the door.

If a movement path of the door in the spatial axis shown in FIG. 1 includes a series of impulses having an amplitude which is greater than a threshold value and exceeds a predetermined period of time or a period t_impulse and is interrupted by pauses between two periods having a time duration t_pause, it is established by the receiver and evaluation unit of the device for determining an unauthorized intrusion at a door, for example, that a certain amount of force in this spatial axis was exerted onto the door, which probably corresponds, e.g., to the door being broken down. Since the door being broken down is an unauthorized intrusion, an algorithm of the device for determining an unauthorized intrusion at a door changes over into the "pre-alarm" state in the following FIG. 4.

If the door is then actually opened in the "pre-alarm" state, which may be detected with the aid of the gyroscope, the algorithm of the device for determining an unauthorized intrusion at a door changes the "pre-alarm" state into "unauthorized intrusion detected" and outputs an alarm signal to the alarm unit and/or to an external electronic unit, for example, a server of a security company, etc.

In this case, e.g., a radio interface may be provided, via which the alarm signal is output by the receiver and evaluation unit to the external electronic unit.

Figure 4:
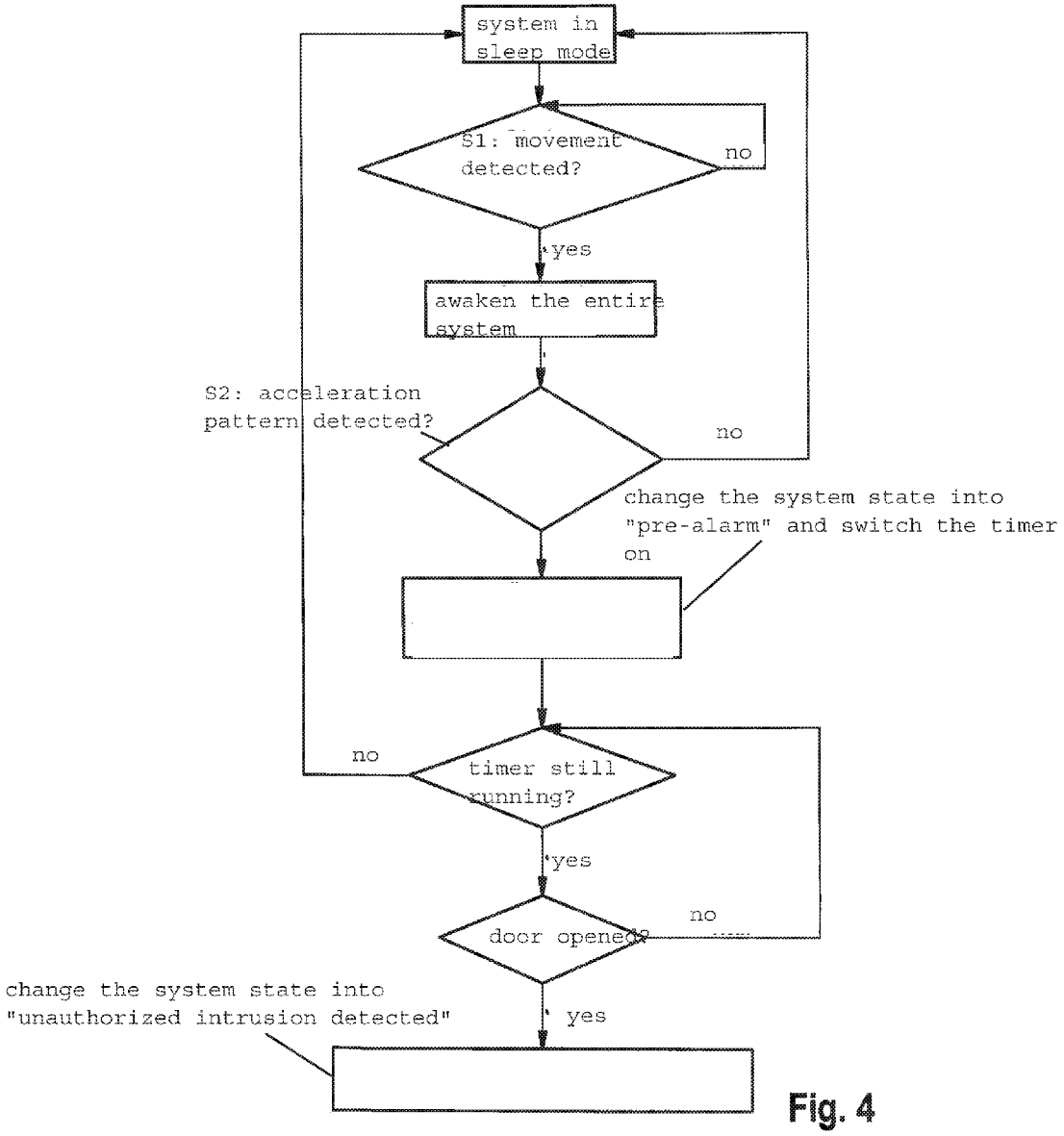
FIG. 4 shows a flow chart of a method for determining an unauthorized intrusion at a door with the aid of the device according to FIG. 1.

FIG. 4 shows a flow chart for determining an unauthorized intrusion at a door with the aid of the device according to FIG. 1.

In a first step S1, the device for determining an unauthorized intrusion at a door is in a so-called "stand-by" mode or sleep mode.

In the "stand-by" mode, the micromechanical (MEMS) acceleration sensor transmits a signal to the receiver and evaluation unit when a force is applied onto the door and this force exceeds a predetermined threshold value. In this case, the signal from the acceleration sensor is preferably merely a binary signal in order to inform the receiver and evaluation unit that a suitably great force is being applied onto the door. In response thereto, the receiver and evaluation unit activates the acceleration sensor in order to detect the acceleration of the door in all three spatial axes as a function of time.

This has the advantage that the device for determining an unauthorized intrusion at a door consumes less energy, since, in the "stand-by" mode, the acceleration sensor is set in such a way that it initially only needs to determine whether a sufficiently great force is being applied onto the door, and the information regarding the application of the sufficiently great force onto the door is transmitted to the receiver and evaluation unit. As a result, the device for determining an unauthorized intrusion at a door requires only very little energy, for example, only a few iA, since an additional generation and evaluation, by the receiver and evaluation unit, of movement signals from the acceleration sensor and signals from the gyroscope in one or multiple spatial axes does not take place.

Once the receiver and evaluation unit has received the information from the acceleration sensor that a suitably great force is being applied onto the door, the receiver and evaluation unit activates or sets the acceleration sensor in all three axes in order to detect the acceleration of the door as a function of time. In addition, the transmission of the information that a force is being applied onto the door, e.g., in the form of a binary signal, to the receiver and evaluation unit also requires little energy. The gyroscope may also be initially shut off or may be in a stand-by mode and may not initially carry out measurements and may be switched on by the receiver and evaluation unit or activated to carry out its measurements only when this unit has determined that there is an unauthorized intrusion at the door with the aid of the acceleration sensor, as described in the following. Additionally, energy may also be saved in this way.

A movement signal from the acceleration sensor in one spatial axis is generated when the door, in particular the closed door, undertakes a movement in this spatial axis, as is shown in FIGS. 2 and 3 by way of example. The closed door may undertake a movement in the three spatial axes, i.e., the x-axis, the y-axis, and the z-axis, in the case of an occurrence such as, for example, when a child strikes the door with his toy, when someone knocks on the door, when someone attempts to forcibly open the door using a picklock, or when, for example, a window of the room closed by the door is pried open using a pry bar, etc. The movement or acceleration of the door in the particular spatial axis as a function of time is transmitted as a movement signal to the receiver and evaluation unit and is evaluated there.

With the aid of the micromechanical (MEMS) gyroscope, in turn, the opening angle of the door may be determined and calculated when this door is opened, for example. In this case, with the aid of the micromechanical (MEMS) gyroscope, for example, the opening angle by which the door is opened or is deflected out of its closed position is determined. This opening angle may be utilized, in turn, for determining whether an unauthorized intrusion through the door was successful or not, as is explained in the following.

If a signal, e.g., a binary signal, from the acceleration sensor is received indicating that a force which has exceeded a threshold value is being exerted onto the door, i.e., step S1: Yes, the device for determining an unauthorized intrusion at a door changes over from the "stand-by" mode into an "active" mode in a second step S2. The device for determining an unauthorized intrusion at a door, which was previously in the "sleep" mode, is now awakened and the acceleration sensor is activated to detect the movement or acceleration of the door in all three spatial axes as a function of time.

However, if no signal from the acceleration sensor is received or if a force is not exerted upon the door or if a sufficiently great force is not exerted upon the door, i.e., step S1: No, the device for determining an unauthorized intrusion at a door remains in the "stand-by" mode.

In the "active" mode, the receiver and evaluation device evaluates the acceleration of the door as a function of time in all three spatial axes, which was detected by the acceleration sensor. In this case, the receiver and evaluation unit determines, with the aid of the acceleration sensor, at least one parameter for each of the spatial axes, such as, e.g., the amplitude level t_level, the period t_impulse, the time duration of a pause t_pause between two consecutive periods, the number of amplitudes which exceed a predetermined amplitude level, the time duration of the pause between two amplitudes which exceed a predetermined amplitude level, etc. The at least one parameter, which the receiver and evaluation unit determines for each spatial axis, may be the same parameter for each of the spatial axes and/or may be a different parameter in this case.

The receiver and evaluation unit compares the measured value or actual value of the parameter of the particular spatial axis with value ranges of the parameter stored in the memory unit for a corresponding occurrence of an authorized or unauthorized intrusion at the door in the particular spatial axis. Occurrences of an unauthorized intrusion are, e.g., the door being opened with the aid of a picklock, ramming the door, for example, with the body or another similarly heavy object, such as a battering ram, etc., the door being broken down using a pry bar, a window of the room closed by the door being broken down using a pry bar, etc. Occurrences for an authorized intrusion are, e.g., a knocking on the door, the door being opened using the assigned key, the door being struck by a toy car, etc.

The aforementioned examples of parameters in one spatial axis, on the basis of which the authorized or unauthorized intrusion through a door is determined, are merely examples and the present invention is not limited to the aforementioned parameters.

The parameters of the three spatial axes, which are evaluated by the receiver and evaluation unit, are preferably selected and combined with one another in such a way that they represent a movement pattern of the door in the three spatial axes for a corresponding occurrence of an authorized or unauthorized intrusion through the door. As previously described, the parameters may be the same or different for each spatial axis in this case.

In this way, it may be determined, by determining the parameters with the aid of the sensors and comparing the values of the parameters with ranges stored in the memory units, which occurrence exists at the door and whether this is an authorized or unauthorized intrusion at the door.

If the receiver and evaluation unit establishes in step S2, after a comparison of the received door-movement signals with ranges for all spatial axes stored in the memory unit, for example, that an authorized intrusion in the form of the door being opened using the assigned key, i.e., step S2: No, the device for determining an unauthorized intrusion at a door returns to the "stand-by" mode of step S1.

If the receiver and evaluation unit establishes in step S2, after a comparison of the received door-movement signals with ranges for at least one of the spatial axes stored in the memory unit, that an unauthorized intrusion exists at the door, e.g., in the form of the door being opened using a picklock, i.e., step S2: Yes, the receiver and evaluation unit switches a timer on or activates this timer in a step S3. In addition, the receiver and evaluation unit activates the gyroscope or switches it on in order to calculate a rotation angle or opening angle of the door. In this case, the angle is calculated, for example, by the receiver and evaluation unit by integration of the rotation rate signals received from the gyroscope. The device for detecting a door movement transitions into the "pre-alarm" mode in this case.

Within the period of time predefined by the timer, the receiver and evaluation unit determines, in step S4, on the basis of the signals from the gyroscope, the opening angle of the door, by which the door has been deflected out of its closed position. In this case, changes in the angle of the door over time are integrated with the aid of the gyroscope.

The receiver and evaluation unit compares the opening angle of the door, e.g., with a predetermined threshold value for the opening angle of the door, which is stored in the memory unit, up to which the door is considered to be closed. If the opening angle of the door is less than or equal to the threshold value for a closed door, the receiver and evaluation unit determines, in step S4, that the door is closed, i.e., step S4: No, and a successful unauthorized intrusion at the door with the aid of a picklock does not exist.

The receiver and evaluation unit then repeats step S4, i.e., the check, with the aid of the signals received from the gyroscope, as to whether the opening angle of the door exceeds the threshold value for the opening angle until the period of time predefined by the timer has expired. After expiration of the period of time predefined by the timer and if it was established by the receiver and evaluation unit that the door was not opened, the device for determining an unauthorized intrusion at a door returns to the "stand-by" mode in step S1.

If the receiver and evaluation unit establishes in step S4 that the opening angle of the door exceeds the threshold value for the opening angle, the receiver and evaluation unit establishes that the door has been opened and a successful unauthorized intrusion through the door exists, i.e., step S4: Yes.

Next, the system state of the device for detecting a door movement changes into the "unauthorized intrusion detected" mode.

In step S5, the receiver and evaluation unit generates an alarm signal and transmits it to an alarm unit in order to output a visual and/or acoustic warning signal and/or the receiver and evaluation unit transmits the alarm signal with the aid of a transmitter to at least one external electronic unit, e.g., a cellular phone, a smartphone, a WLAN router, a server, a fax machine, a PC, a laptop, a tablet PC, etc. belonging to the owner of the door in front of a room to be protected against unauthorized intrusion, or belonging to the police or a security service. On the basis of the information relayed by the alarm signal, such as, e.g., the occurrence of the unauthorized intrusion, the point in time of the unauthorized intrusion and/or the position or location of the room, which is closed by the door, etc., the recipient may take appropriate countermeasures, such as sending the police to the room to be protected by the door. The method and the device for detecting a door movement have the advantage that, if nothing happens at the door, i.e., if the door is left alone, the sensors and the microcontroller are kept in a low-energy mode in order to extend the battery service life for as long as possible.

As soon as a force is exerted onto the door in at least one spatial axis and exceeds a threshold value, this is detected by the acceleration sensor and is reported to the microcontroller. Thereupon, the microcontroller activates the MEMS acceleration sensor to now detect the movement or acceleration of the door in all three spatial axes as a function of time. The microcontroller subsequently evaluates the signals from all three spatial axes, which it receives from the MEMS acceleration sensor, and determines whether an occurrence of an authorized or an unauthorized intrusion at the door exists. If an unauthorized intrusion is established, the microcontroller determines whether the unauthorized intrusion is successful and the door has been opened.

Since an algorithm according to the present invention may distinguish, in the way previously described with reference to FIG. 4 by way of example, between the situations "door is at rest" and "something is happening at the door and it is either an authorized or an unauthorized intrusion at the door," the algorithm may calibrate displacements and deviations due to temperature and aging of the sensors.

The present invention is also robust with respect to false alarms, since, by analyzing the acceleration patterns measured at the door, an authorized opening of the door or the window may be distinguished from an unauthorized opening and, in addition, an alarm may be triggered only when an established unauthorized opening, e.g., with the aid of a picklock, was successful, i.e., the door was actually opened. Correspondingly, a normal occurrence at the door, such as, for example, the knocking on the door in order to allow a visitor to enter or a child striking the door with a toy car, does not result in the algorithm setting the "pre-alarm" state, as was previously explained with reference to FIG. 4.

Although the present invention was completely described above on the basis of preferred exemplary embodiments, it is not limited thereto. Instead, the present invention is modifiable in various ways.

What is claimed is:

1. A method for determining the unauthorized intrusion through a door and opening of the door, the door including any closure of an opening in a wall, the method comprising:

a) determining a movement path of the door as a function of time in all three spatial axes by a receiver and evaluation unit using a movement sensor in an active mode;

b) determining parameters, using the receiver and evaluation unit, in all three spatial axes based on the movement path of the door as a function of time, the movement path being determined using the movement sensor, the receiver and evaluation unit determining that an unauthorized intrusion at the door exists when the actual value of a particular parameter is within an assigned parameter range for the unauthorized intrusion, the parameter range being stored in a memory unit;

c) after the unauthorized intrusion at the door has been determined by the receiver and evaluation unit, determining an opening angle of the door using the receiver and evaluation unit using an angle measuring sensor;

d) comparing the opening angle of the door with a threshold value for a closed door using the receiver and evaluation unit;

e) determining, by the receiver and evaluation unit, that the door has been opened when the opening angle exceeds the threshold value for the closed door; and f) outputting, by the receiver and evaluation unit, an alarm signal if the door has been opened.

2. The method as recited in claim 1, wherein the angle measuring sensor is switched on or activated by the receiver and evaluation unit for detecting an opening angle of the door when an unauthorized intrusion is detected.

3. The method as recited in claim 1, wherein the movement sensor detects, in step a) in a stand-by mode, an application of a force onto the door and transmits a signal, to the receiver and evaluation unit if the force on the door exceeds a threshold value for a force minimum, and the receiver and evaluation unit activates the movement sensor in the active mode to detect the movement path of the door in all three spatial axes as a function of time.

4. The method as recited in claim 3, wherein, in step b), the receiver and evaluation unit activates a timer when an unauthorized intrusion at the door has been determined, and the determination of the opening angle in step c) and the comparison of the opening angle with the threshold value in step d) is repeated until either it is determined within the predefined period of time in step e) that the door has been opened, or that the period of time predefined by the timer has expired and an opening of the door has not been determined in step e), the receiver and evaluation unit returning to the stand-by mode of step a) when the predefined period of time has expired and an opening of the door has not been determined in step e).

5. The method as recited in claim 1, wherein parameter ranges for multiple occurrences of an unauthorized intrusion are retrievably stored in the memory unit and the receiver and evaluation unit determines, in step b), that an occurrence of the unauthorized intrusion at the door exists when the actual value of the particular parameter is within the parameter range for the occurrence of the unauthorized intrusion and the occurrences for the unauthorized intrusion at the door are occurrences at least one of: i) as the door being opened with the aid of a picklock, ii) the door being opened with the aid of a pry bar, iii) a window being opened using a pry bar in the room closed with the aid of the door, and iv) a ramming of the door.

6. The method as recited in claim 3, wherein parameter ranges for multiple occurrences of an authorized intrusion are retrievably stored in the memory unit, the occurrences of the authorized intrusion at the door preferably being occurrences including at least one of: i) a knocking on the door, ii) striking the door with a toy car, iii) striking the door with a shopping bag, and iv) opening the door with the assigned key, and wherein in step b), the receiver and evaluation unit determines that an occurrence of the authorized intrusion at the door exists when an actual value of the particular parameter is within the parameter range for the occurrence of the authorized intrusion, and the receiver and evaluation unit returns to the stand-by mode of step a).

7. The method as recited in claim 1, wherein parameters in at least one of the spatial axes are at least one of: i) an amplitude level, ii) a period, iv) a duration of a pause between two consecutive periods, v) a number of the amplitudes which exceed a predetermined amplitude level, and vi) a duration of the pause between two amplitudes which exceed a predetermined amplitude level.

8. The method as recited in claim 1, wherein the alarm signal is transmitted to at least one of an alarm unit and at least one external electronic unit.

9. The method as recited in claim 1, wherein the alarm signal is transmitted to at least one the external electronic unit, the external electronic unit including at least one of: a cellular phone, a smartphone, a server, a WLAN router, a PC, a tablet PC, a laptop, and a fax machine.

10. The method as recited in claim 1, wherein the movement sensor is an acceleration sensor and the angle measuring sensor is a gyroscope.

11. A device for determining unauthorized intrusion through a door and opening of the door, the door including any closure of an opening in a wall, the device comprising:

a movement sensor for determining a movement path of the door as a function of time in all three spatial axes;

an angle measuring sensor for determining an opening angle of the door;

a memory unit in which parameter ranges for parameters in all three spatial axes for an unauthorized intrusion at the door are stored, and at least one threshold value for an opening angle of a closed door; and a receiver and evaluation unit to determine actual values of the parameters based on the movement path of the door as a function of time, determined using the movement sensor, the receiver and evaluation unit to determine an unauthorized intrusion at the door when the actual value of the particular parameter is within the assigned parameter range stored in the memory unit, the receiver and evaluation unit designed to compare, after determining the unauthorized intrusion at the door, the opening angle of the door, measured using the angle measuring sensor, with the threshold value, and the receiver and evaluation unit designed to output an alarm signal when the opening angle of the door exceeds the threshold value for the opening angle of the closed door.

12. The device as recited in claim 11, wherein the device one of: includes an alarm unit, or is coupleable to the alarm unit, the receiver and evaluation unit transmitting the alarm signal to the alarm unit for generating a warning signal.

13. The device as recited in claim 12, wherein the warning signal is one of a visual warning signal or an acoustic warning signal.

14. The device as recited in claim 11, wherein the device includes a transmitter for transmitting the alarm signal to at least one external electronic unit.

15. The device as recited in claim 14, wherein the at least one external electronic unit includes at least one of: a cellular phone, a smartphone, a server, a WLAN router, a PC, a tablet PC, a laptop, and a fax machine.

16. The device as recited in claim 14, wherein the device includes an energy supply unit for supplying with energy at least one of: the movement sensor, the angle measuring sensor, the alarm unit, and the transmitter, the energy supply unit including at least one of at least one battery.

17. The device as recited in claim 16, wherein the at least one battery is rechargeable.

18. The device as recited in claim 11, wherein the movement sensor is an acceleration sensor and the angle measuring sensor is a gyroscope.

* * * * *